US007497709B1

(12) United States Patent
Zhang

(10) Patent No.: US 7,497,709 B1
(45) Date of Patent: Mar. 3, 2009

(54) ELECTRICAL CONNECTOR WITH SWITCH DEVICE

(75) Inventor: George (Huanyi) Zhang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/900,609

(22) Filed: Sep. 12, 2007

(51) Int. Cl.
*H01R 29/00* (2006.01)

(52) U.S. Cl. ..... 439/188; 200/51.09

(58) Field of Classification Search ..... 439/79, 439/80, 188, 489; 200/51.09, 51.1, 243
See application file for complete search history.

(56) References Cited

U.S. PATENT DOCUMENTS

| | | | | |
|---|---|---|---|---|
| 5,098,306 | A * | 3/1992 | Noschese et al. | 439/188 |
| 5,277,602 | A * | 1/1994 | Yi | 439/138 |
| 5,871,368 | A * | 2/1999 | Erdner et al. | 439/188 |
| 6,095,837 | A * | 8/2000 | David et al. | 439/188 |
| 6,331,122 | B1 | 12/2001 | Wu | |
| D469,407 | S | 1/2003 | Wu | |
| 6,712,632 | B2 * | 3/2004 | Wu | 439/328 |
| 6,746,281 | B1 * | 6/2004 | Zhang | 439/637 |
| 6,824,426 | B1 * | 11/2004 | Spink, Jr. | 439/579 |
| 6,832,934 | B1 * | 12/2004 | Zhang | 439/660 |
| 6,942,524 | B2 | 9/2005 | Wu | |
| 7,238,054 | B2 * | 7/2007 | Higeta et al. | 439/637 |

* cited by examiner

*Primary Examiner*—Thanh-Tam T Le
(74) *Attorney, Agent, or Firm*—Wei Te Chung

(57) ABSTRACT

An electrical connector (100) includes an insulated housing (1), a number of terminals (2) received in the insulated housing (1) and a metal bar (3) received in the insulated housing (1). The insulated housing (1) defines a mating portion which has a bottom wall (11), an up wall (12) and a pair of side walls (13) interconnecting with the bottom and the up walls (11, 12) to form a receiving space. A majority of the terminals (2) are separated into two distinct groups (21, 22) and received in the bottom wall (11) of the insulated housing (1). While an additional pair of the terminals (23) is received in the up wall (12) of the insulated housing (1). And the metal bar (3) is inserted into the up wall (12) of the insulated housing (1) either. The pair of terminals (23) and the metal bar (3) consist a switch device, and when the electrical connector (100) mates with a complementary connector, the switch device is shut to give a detective signal.

16 Claims, 9 Drawing Sheets

ELECTRICAL CONNECTOR WITH SWITCH DEVICE

BACKGROUND OF THE INVENTION

1. Field of the Invention

The present invention generally relates to an electrical connector, and more particularly to a high-speed transmission electrical connector.

2. Description of Related Art

Parallel ATA (Advanced Technology Attachment) and parallel SCSI are two dominant hard disk (HD) interfaces technologies today. The parallel ATA disks are widely used in desktop PCs and portable PCs, and the parallel SCSI disks are mainly used in high-volume servers and subsystems. As disk interconnect speeds continue to rise, existing parallel ATA and parallel SCSI buses are reaching their performance limits because that parallel transmissions are susceptible to crosstalk across multiple streams of wide ribbon cable that adds line noise and can cause signal errors—a pitfall that has been remedied by slowing the signal, limiting cable length or both. Therefore, new interconnect technologies are needed to meet performance requirements going forward. The serial technology is emerging as a solution to the problem. The main advantage of serial technology is that while it does move data in a single point-to-point stream, it does so much faster than parallel technology because it is not tired to a particular clock speed.

Serial ATA (SATA) is a serial version of ATA, which is expected to be a replacement for parallel ATA. U.S. Pat. No. 6,331,122 discloses a type of SATA receptacle connector for being mounted on a Printed Circuit Board. The receptacle connector has two receiving cavities defined in an insulative housing thereof and two sets of conductive contacts respectively used for power and signal transmission installed in the insulative housing. Another U.S. Pat. No. D469, 407 discloses an electrical connector assembly with a SATA plug connector as a part thereof. The plug connector has two generally L-shaped tongue plates receiving two sets of terminals for electrically connecting the conductive contacts as the tongue plates are inserted into the respective receiving cavities of the receptacle connector.

Serial Attached SCSI (SAS) is a successor to the parallel SCSI and is also based on serial technology. Besides the advantage of higher speed signal transmission, another most significant advantage is the SAS interface will also be compatible with SATA drives. In other words, the SATA plug connector can plug directly into an SAS receptacle connector if supported in the system. By this way, the system builders are flexible to integrate either SAS or SATA devices and slash the costs associated with supporting two separate interfaces.

U.S. Pat. No. 6,942,524 discloses a kind of SAS receptacle connector which has generally the same configuration as the SATA receptacle connector except that the two cavities of the SATA receptacle connector are merged in a large one of the SAS receptacle connector, and a third set of signal contacts are assembled to a second side wall opposing to a first side wall where two sets of contacts have already being assembled. The SAS receptacle connector is usually mounted on a main-board of a computer/server and the aforementioned SATA plug connector assembled to a hard disk (HD). When the SATA connector mates with SAS receptacle connector, and special software stored in the computer/server is used to detect that the hard disk (HD) has already connected to the computer/server, and then the computer/server may read data from HD or write data onto HD; however, sometimes, the software fails to access a signal detection and it couldn't distinguish whether there is a connection between HD and computer or the HD is broken.

Hence, an improved electrical connector with a detective device is highly desired to overcome the disadvantages of the related art.

SUMMARY OF THE INVENTION

Accordingly, an object of the present invention is to provide an electrical connector with a switch device coming out a detection signal which facilitates a computer/server to distinguish that a hard disk coupled thereto is available.

In order to achieve the object set forth; an electrical connector in accordance with the present invention comprises an insulated housing, a number of terminals received in the insulated housing and a metal bar received in the insulated housing. The insulated housing defines a mating portion which has a bottom wall, an up wall and a pair of side walls interconnecting with the bottom and the up walls to form a receiving space. A majority of the terminals separated into two distinct groups and received in the bottom wall of the insulated housing. While an additional pair of the terminals received in the up wall of the insulated housing. The metal bar is inserted into the up wall of the insulated housing either. The pair of terminals and the metal bar consist a switch device. The pair of terminals and the metal bar are arranged and configured such that the pair of terminals are capable of moving to contact the metal bar when the electrical connector mate with a complementary connector and the pair of terminals further disengage from the metal bar when the electrical connector unmates from the complementary connector.

Other objects, advantages and novel features of the invention will become more apparent from the following detailed description when taken in conjunction with the accompanying drawings.

DETAILED DESCRIPTION OF THE INVENTION

Figure 1:
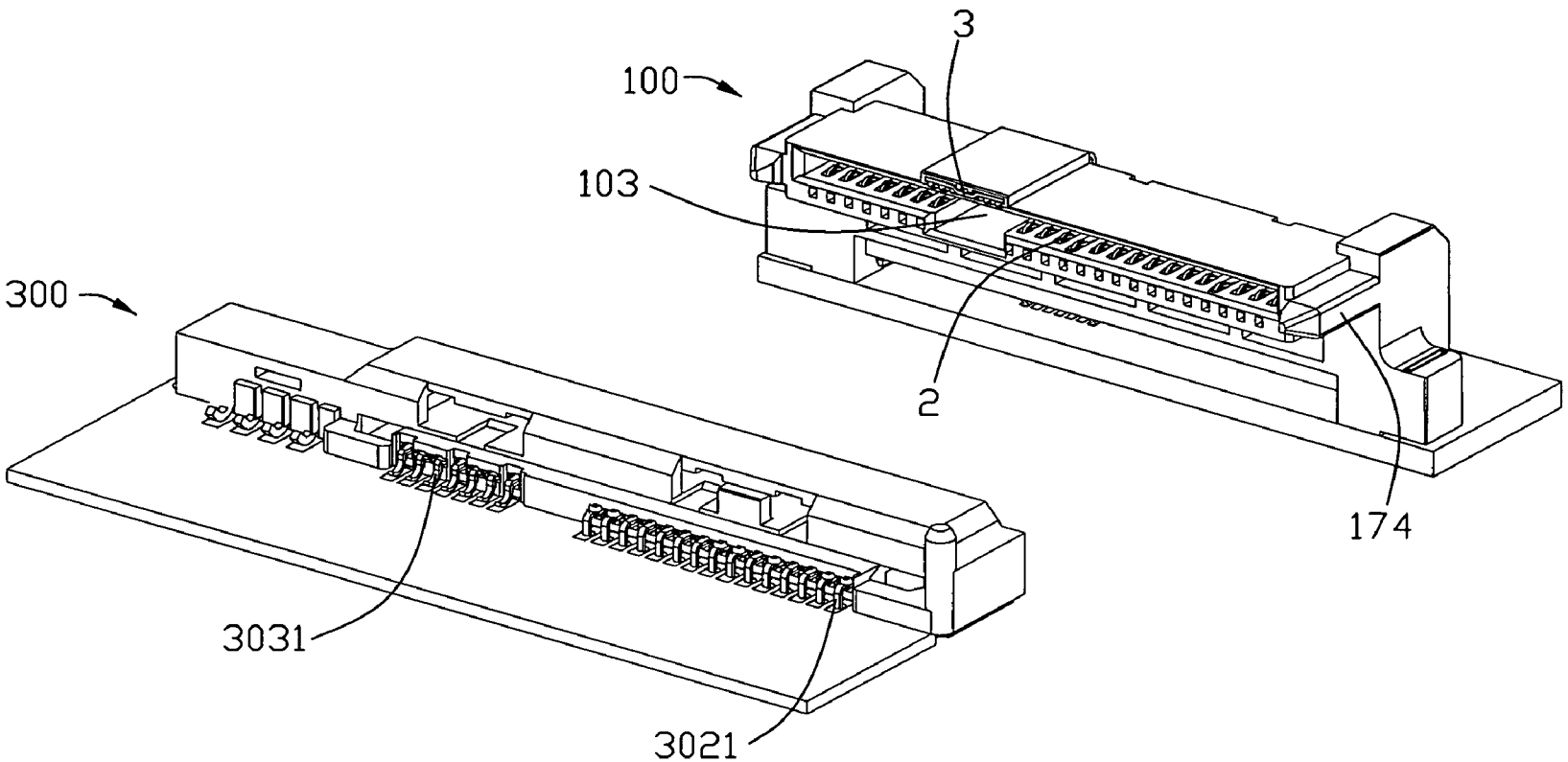
FIG. 1 shows an electrical connector adapted for a computer/sever and a complementary electrical connector for a hard disk (HD)
Figure 2:
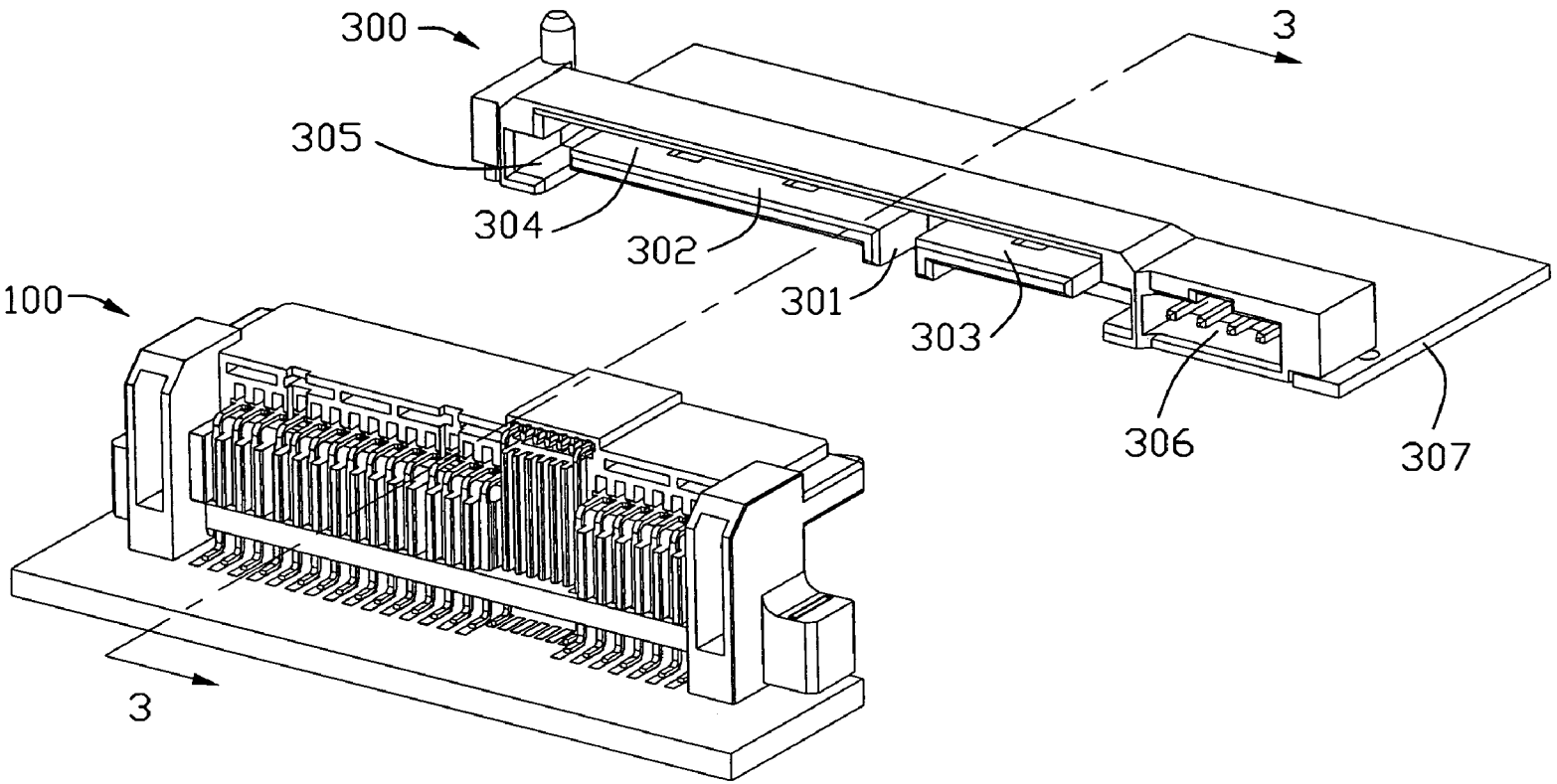
FIG. 2 is a view similar to FIG. 1, but viewed from another aspect.
Figure 3:
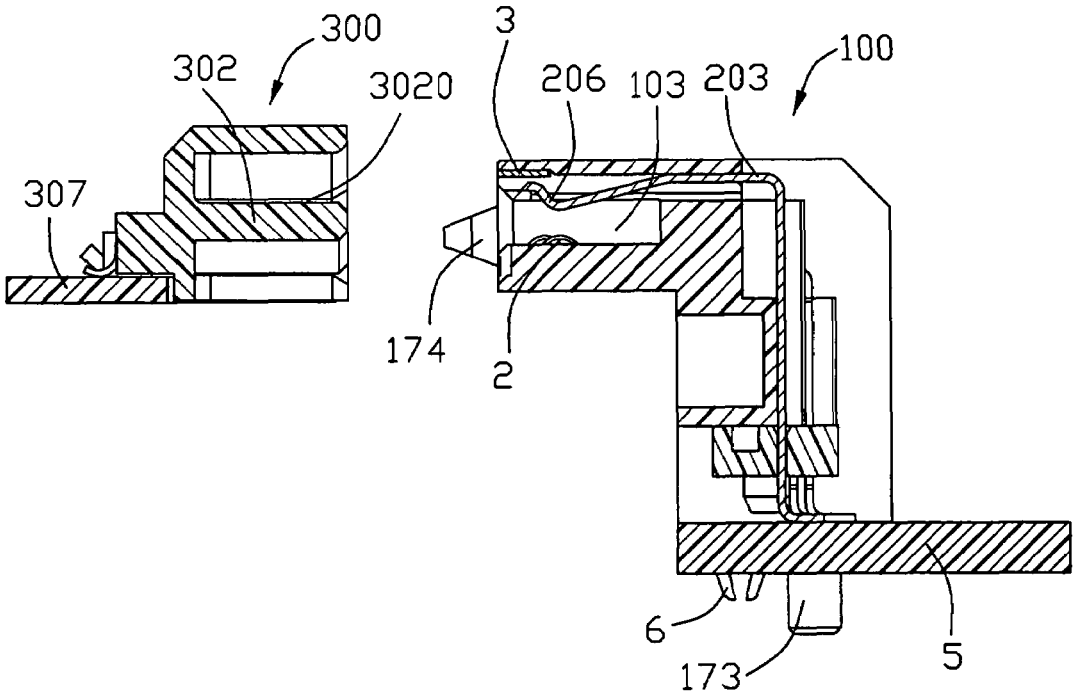
FIG. 3 is a cross-section view taken along line 3-3 of the electrical connector and the complementary electrical connector shown in FIG. 2.
Figure 4:
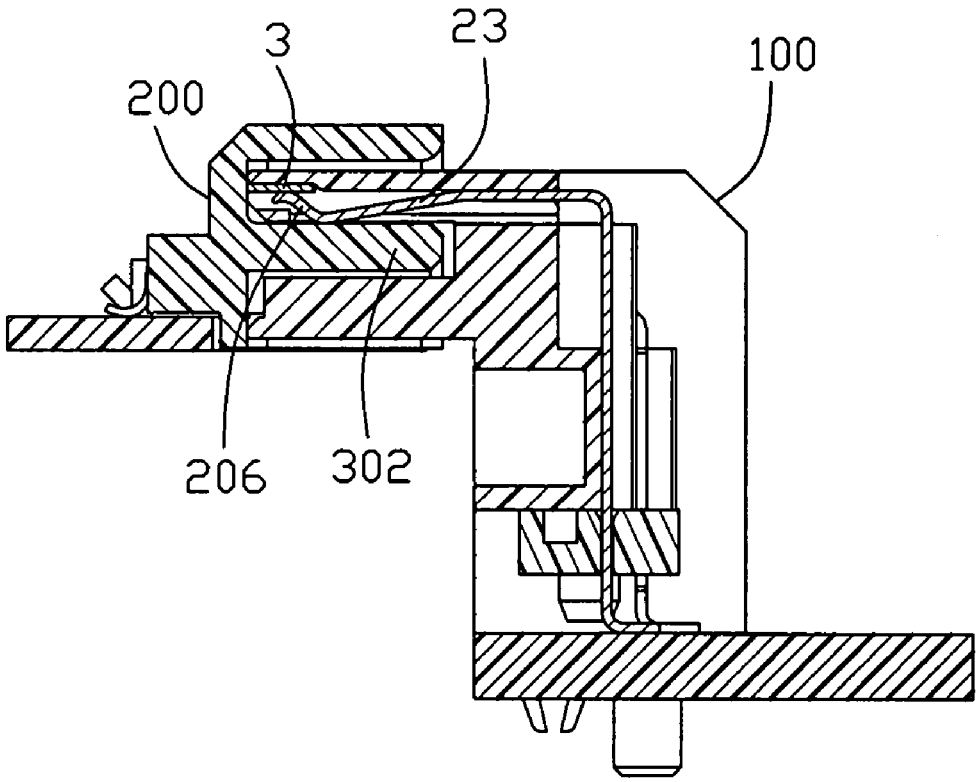
FIG. 4 is a view further illustrates the electrical connector mating with the complementary electrical connector as shown in FIG. 3.

Reference will now be made in detail to the preferred embodiment of the present invention.

Referring to FIGS. 5-9, an electrical connector 100 in accordance with the present invention is mounted on a printed circuit board (PCB) 5 of a computer/server (not shown), and the electrical connector 100 comprises an insulated housing 1, a plurality of terminals 2 received in the insulated housing 1, a metal bar 3 inserted into the insulated housing 1 and detaching from the terminals 2, and a spacer 4 for positioning the terminals 2 assembled to the insulated housing 1.

The insulated housing 1 comprises an upright base portion 1*a* and a horizontal mating portion 1*b* located on a top surface of the base portion 1*a* and forwardly extending beyond the base portion 1*a*.

Figure 9:
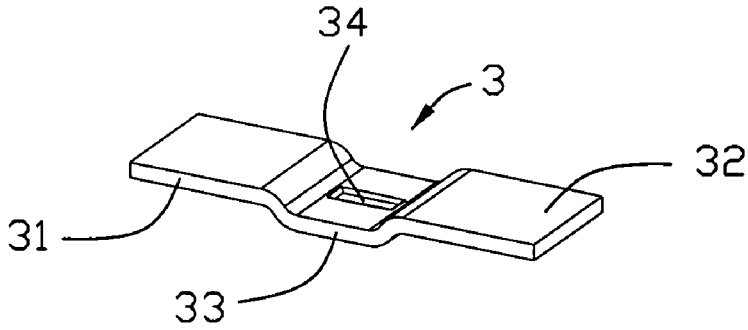
FIG. 9 is an enlarged view of encircled portion of the electrical connector of FIG. 5 and a metal bar.
Figure 9:
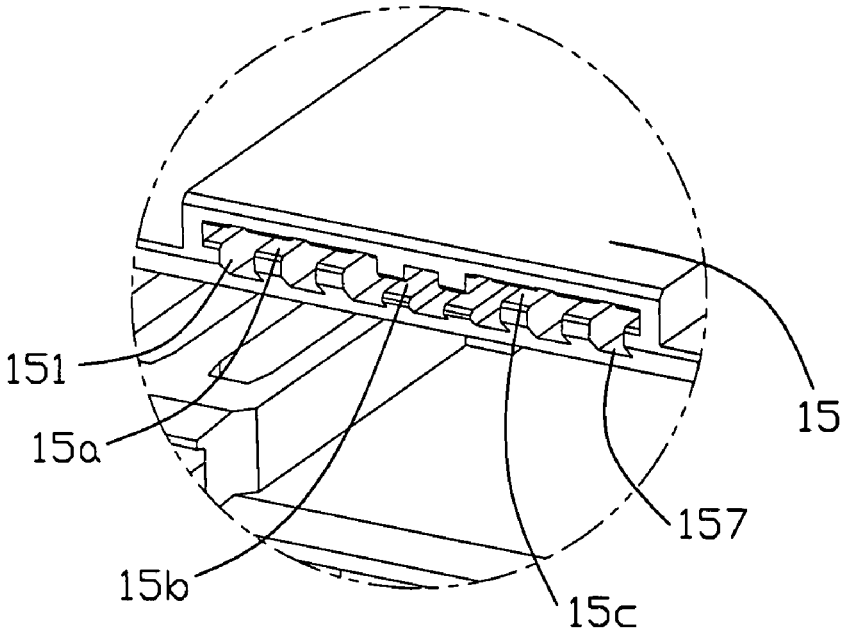

The mating portion 1*b* includes a bottom wall 11, an opposing up wall 12 and a pair of side walls 13 interconnecting with the bottom and the up walls 11, 12 to form a receiving space 103. The bottom wall 11 has a broad rectangular-shaped slot 14 which separates the bottom wall 11 into a first section 101 and a second section 102 larger than the first section 101. The first section 101 defines seven terminal passages 112 in a row, and the second section 102 also defines fifteen terminal passages 111 in a row. Opposite to the slot 14 of the bottom wall 11, the up wall 12 forms an expansion portion 15 which is thicker than other part thereof. Referring to FIG. 9, the expansion portion 15 defines seven terminal passages, then along the transversal direction, the terminal passages are sequentially numbered, and the first terminal passage being numeral 151, the seventh terminal passage being numeral 157, and other terminal passages omitted numeral. Thus, the expansion portion 15 is substantially divided into three sections including the left section comprising the first terminal passage 151 and the second terminal passage adjacent to the first terminal passage 151, the right section 15 comprising the seventh terminal passage 157 and the sixth terminal adjacent to the last terminal passage 157, and the middle section comprising remaining three terminal passages. Upper parts of the left section and the right section are cut to form a first rectangular-shaped recess portion 15*a* and a third rectangular-shaped recess portion 15*c*, while lower part of the middle section is cut to form a second rectangular-shaped recess portion 15*b*.

The base portion 1*a* includes a lengthwise body portion 16 and a pair of supporting portions 17 arranged at left and right ends of the body portion 16. The body portion 16 rearward extends beyond an end surface of the mating portion 1*b* to form a first protrusion portion 161 and a second protrusion portion 162 separated from each other by a large opening 160. The first protrusion portion 161 defines seven vertical channels 1611 corresponding to the terminal passages 112 of the mating portion 1*b*, while the second protrusion portion 162 also defines a fifteen vertical channels 1621 corresponding to the terminal passages 111 of the mating potion 1*b*. A cubic block 163 disposed in the opening 160 extends upward till an end edge of the expansion portion 15. The cubic block 163 also has five vertical channels (not numbered) corresponding to the five terminal passages between the terminal passages 151, 157 of the expansion portion 15. Each supporting portion 17 forms a retainer portion 171 on a lower end of an outward surface thereof and the retainer portion 171 further has a through slot 172 thereon, and the supporting portion 17 further has a positioning post 173 extending downwardly from a bottom surface thereof. A pair of wedge-shaped stoppers 175 are respectively formed on the inner surfaces of lower portions of the supporting portions 17, and a pair of guiding posts 174 respectively located outside of the side walls 13 and forwardly extends from front surfaces of an upper portions of the supporting portion 17.

The terminals 2 are separated into three distinct groups, and a first group of terminals 21 having seven individual terminals for transmitting data, a second group of terminals 22 including fifteen single terminals for transmitting power, while a third group of terminals 23 only consisting of two terminals. Each of the first group of terminals 21 and the second group of terminals 22 has identical profile, comprising a curved mating portion 201 with a deflexed distal end, a slightly slant body portion 202 extending rearward from an end of the mating portion 201, a vertical leg portion 204 extending downward from an end of the body portion 202 and a planar foot portion 205 extending rearward from an end of the leg portion 204. The body portion 202 of each of the first group of terminals 21 and the second group of terminals 22 further forms barbs 203 thereon to increase a retention force between the terminals 2 and the insulated housing 1. Each of the third group of terminals 23 also has substantially same configuration as that of the first group of terminals 21 and the second group of terminals 22, except for a mating portion 206 with an upswept distal end, a curved body portion 207 and a longer leg portion 208, compared with corresponding parts of the terminals of the first group of terminals 21 and the second group of terminals 22. That is to say the mating portions 206 and the body portions 207 of the third group of terminals 23 located at a higher place than those of the first group and the second group of terminals 21, 22.

Referring to FIG. 9, the metal bar 3 includes a pair of horizontal wing portions 31, 32 located at an imaginary plane (not shown) and align with each other, and a transition portion 33 parallel to and connecting with the pair of wing portions 31, 32 via opposite inclined end portions (not numbered). A central part of the transition portion 33 is stamped to form a rectangular-shaped protrusion portion (not shown) on a bottom surface thereof, thus a corresponding rectangular-shaped depression portion 34 is left on a top surface thereof.

Figure 5:
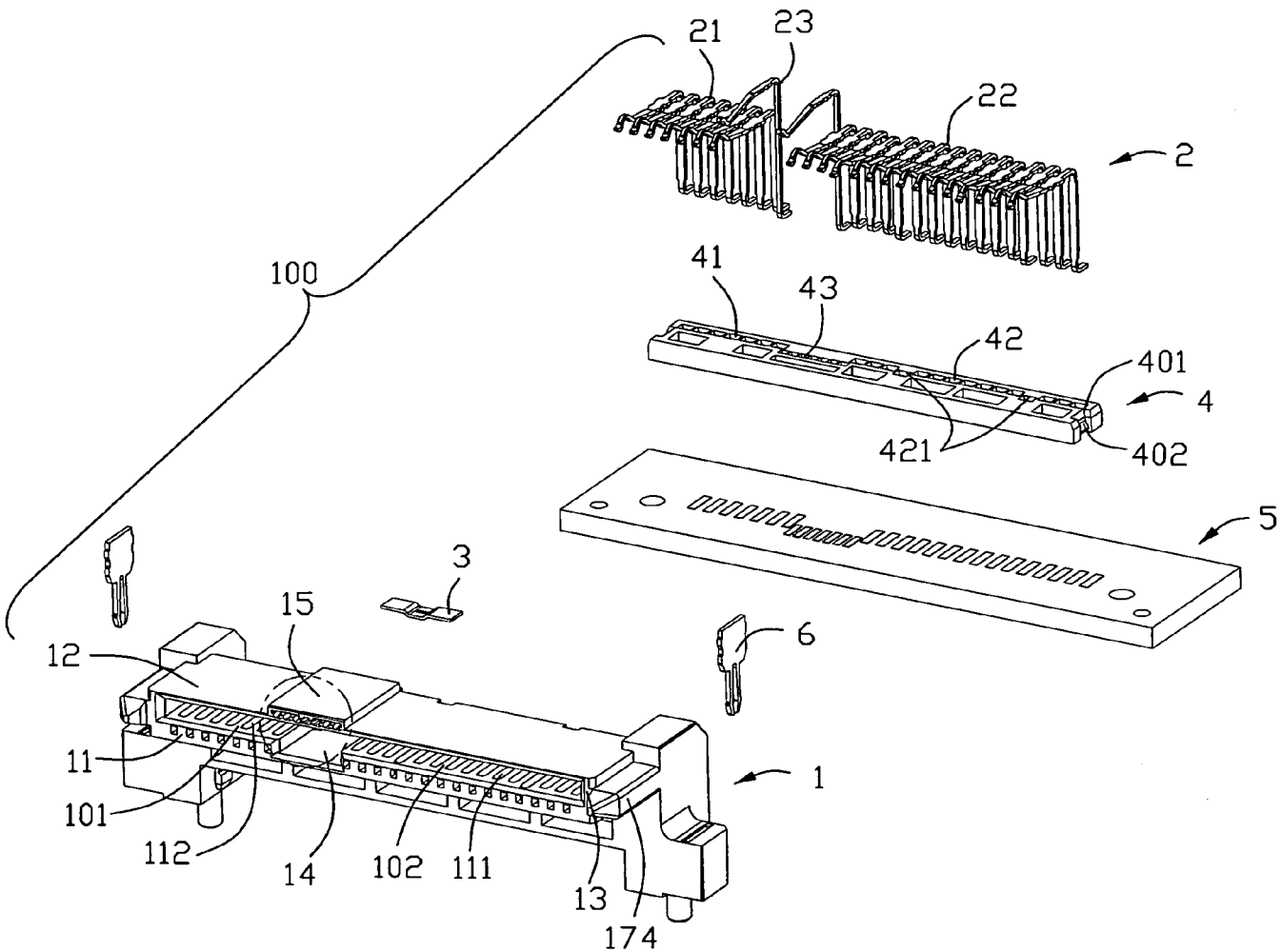
FIG. 5 is an exploded, perspective view of the electrical connector in accordance with the present invention.
Figure 6:
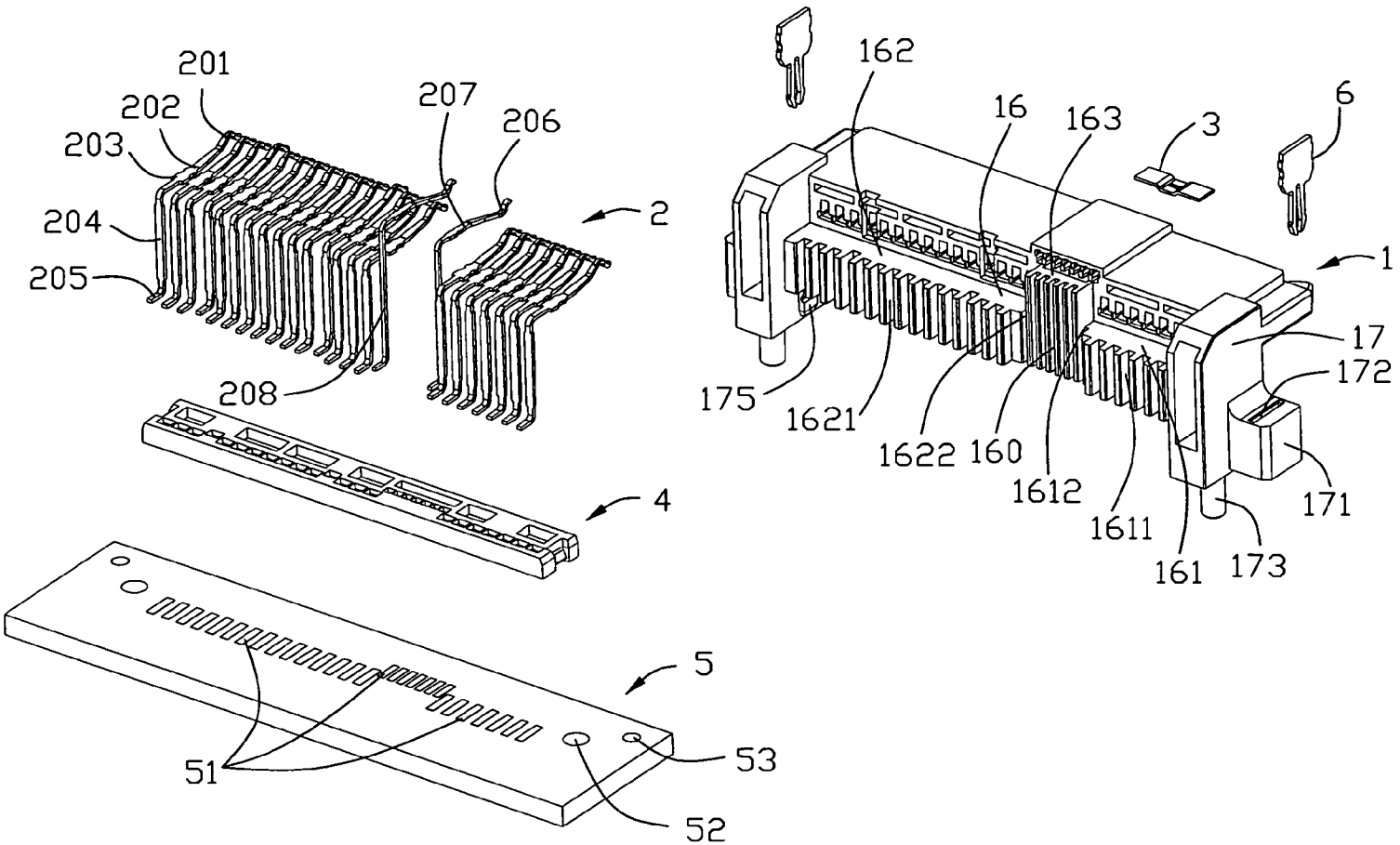
FIG. 6 is a view similar to FIG. 5, but viewed from another aspect.
Figure 7:
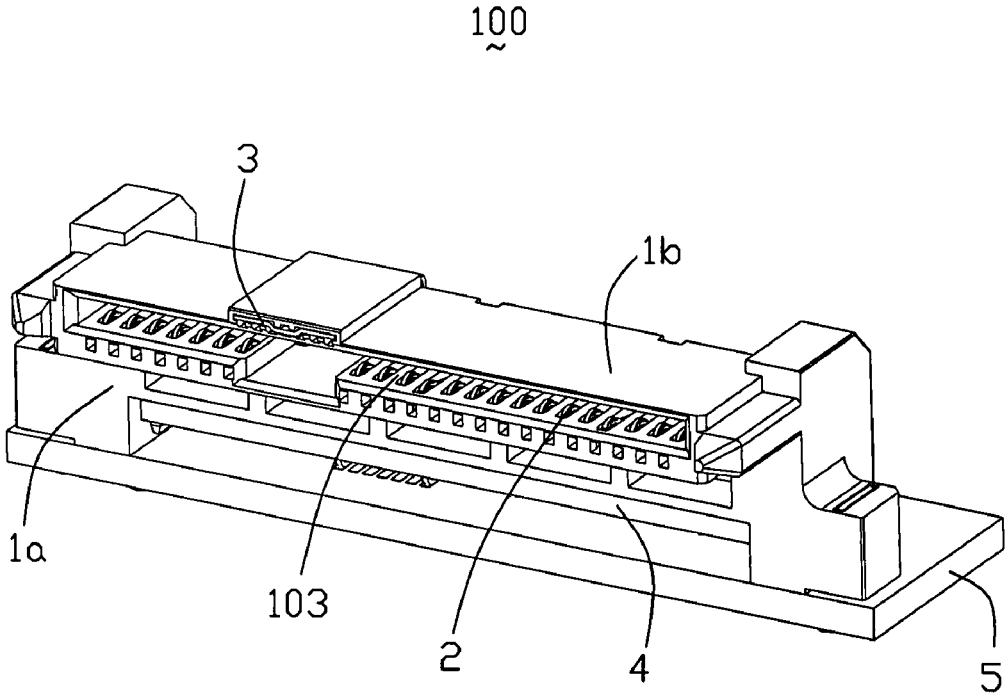
FIG. 7 is an assembled, perspective view of FIG. 5.
Figure 8:
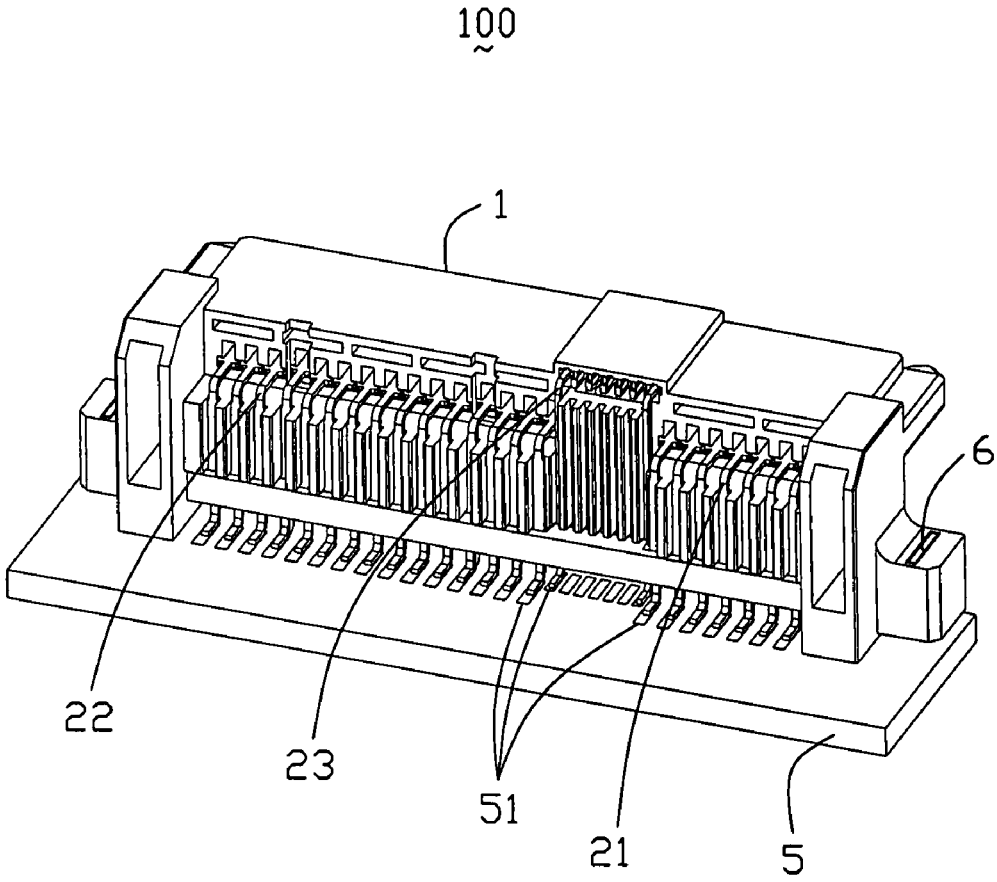
FIG. 8 is a view similar to FIG. 7, but viewed from another aspect.

Referring to FIGS. 5-6, the spacer 4 is a lengthwise body portion which defines a first row of through holes 41 for receiving the leg portions 204 of the first group of terminals 21, a second row of through holes 42 for receiving the leg portions 204 of the second group of terminals 22 and a third row of through holes 43 for receiving the leg portions 204 of the third group of terminals 23. The first row of through holes 41 and the second row of through holes 42 align in line along transversal direction, except that a fourth and an eleventh through holes 421 are a little offset from other through holes 42. The third row of through holes 43 are offset from and parallel to the first row of through holes 41 and the second row of through holes 42. Two opposite ends of the spacer 4 are respectively defined a cutout 401 with a wedged tab 402 therein.

When assembly, firstly, the metal bar 3 is assembled to the expansion portion 15 of the insulated housing 1, with the pair of wing portions 31, 32 and the transition portion 33 of the metal bar 3 respectively inserted into the left recess portion 15*a*, the right recess portion 15*c* and the middle recess portion 15*b*. The protrusion portion of the bottom surface of the transition portion 33 may increase retention force between the metal bar 3 and the expansion portion 15. Secondly, the terminals 2 are assembled to the insulated housing 1, with the mating portions 201 and the body portions 202 of the first group of terminals 21 and the second group of terminals 22 respectively inserted into the terminal passages 111, 112 of the bottom wall 11, and the mating portions 201 and the body portions 202 of the third group of terminals 23 inserted into terminal passages 151, 157 of the expansion portion 15 of the up wall 12; then upper sections of the leg portions 204 of the first group of terminals 21 and the second group of terminals 22 pressed fitted into the vertical channels 1611, 1621 of the first protrusion portion 161 and the second protrusion portion 162 of the body portion 16, and then the upper sections of the leg portions 204 of the third group of terminals 23 pressed fitted into gaps 1612, 1622 formed between the first protrusion portion 161, the second protrusion portion 162 and the cubic block 163. The gaps 1612, 1622 are recessed forwardly than the vertical channels 1611, 1621 of the first protrusion portion 161 and the second protrusion portion 162 of the body portion 16.

Thirdly, the leg portions 204 of the terminals 2 are inserted into through holes 41, 42, 43 of the spacer 4, then the spacer 4 is assembled to the insulated housing 1, sandwiched between the pair of supporting portions 17 and abutting against a bottom surface of the body portion 16 of the base portion 1*a*, and the pair of stoppers 175 of the supporting portions 17 engaging with the tabs 402 of the spacer 4 to provide a retaining force. The leg portions 204 of the terminals 2 are bent at an angle about ninety degrees to form planar foot portions 205. Fourthly, the insulated housing 1 is mounted to the printed circuit board (PCB) 5, with the pair of positioning posts 173 respectively inserted into a pair of first retaining holes 52 of the PCB 5, the foot portions 205 of the terminals 2 disposed on conductive pads 51 of the PCB 5 and soldered thereon. Fifthly, two board-locks 6 are respectively inserted into the through slots 172 of the retainer portion 171 of the insulated housing 1 and latch with lock holes 53 of the PCB 5, therefore, the insulated housing 1 can be securely mounted on the PCB 5. As the upper sections of the leg portions 204 of the first group of terminals 21 are disposed in the vertical channels 1611, thus the permittivity/dielectrical constant around the first group of terminals 21 increases and the electrical quality (high frequency characteristic) of the first group of terminals 21 can be improved.

Referring to FIGS. 1-4, a complementary connector 300 is illustrated, the connector 300 is mounted on a circuit substrate 307 of hard disk (not shown), and the connector 300 includes a first mating port 301 and a second mating port 306. The first mating port 301 has a hollow portion 304 and two guiding passages 305 located at opposite sides of the hollow portion 304. A pair of L-shaped tongue portions 302, 303 with different dimensions arranged in side-by-side manner and received in the hollow portion 304. Both the tongue portions 302 and 303 have a number of terminals 3021, 3031 arranged thereon and electrically connecting to conductive pads (not numbered) of the circuit substrate 307.

When the complementary connector 300 mates with the electrical connector 100, firstly, the guiding posts 174 are inserted into the guiding passages 305, then the tongue portions 302, 303 are inserted into the receiving space 103 of the insulated housing 1 of the electrical connector 100. Secondly, the terminals 21, 22 contact the terminals 3021, 3031 of the complementary connector 300 to form electrical connection. Simultaneously, an upper surface 3020 of tongue portion 302 (See FIGS. 3-4) and another upper surface of the tongue portion 303 respectively press the mating portions 206 of the pair of the third group of terminals 23, thus the mating portions 206 move upward till contact the metal bar 3. Therefore a closed circuit is formed between the pair of the third group of terminals 23 and the metal bar 3, then a detective/shutting signal is given and the computer is noticed, and the computer can read data from HD or write data onto HD. When the complementary connector 300 disengages from the electrical connector 100, the mating portions 206 of the pair of third group of terminals 23 are apart from the metal bar and return to its original position. In the embodiment of the present invention, the metal bar 3 and the pair of the third group of terminals 23 consist of a switch device in opening status, and when the complementary connector 300 mates with the electrical connector 100, the switch device is closed.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed. For example, in this embodiment using a pair of additional terminals connected with a metal bar, anyhow the metal bar may be deemed as another type terminal or even further integrally/unitarily joined with one of said terminals for simplification. On the other hand, even if in this embodiment the metal bar is stationary and the switch contacts, i.e., the third group of terminals 23, are deflectable, understandably it is optional that in another embodiment the metal bar may be moveable and actuated by the mating connector while the switch contacts, i.e., the third group of terminals 23, are fixed instead.

What is claimed is:

1. An electrical connector for high-speed transmission, comprising:

an insulated housing defining a mating portion, said mating portion having a bottom wall, an up wall and a pair of side walls interconnecting with the bottom and the up walls to form a receiving space;

a plurality of terminals separated into two distinct groups and received in the bottom wall of the insulated housing and partially exposed into the receiving space;

an additional pair of terminals received in the up wall of the insulated housing; and a recess portion defined in the up wall and arranged above the additional pair of terminals to have the up wall partially divided into an upper piece and a lower piece discrete from one another;

a metal bar located in the recess portion and sandwiched between the upper piece and the lower piece; and wherein the pair of terminals and the metal bar are arranged and configured such that the pair of terminals are capable of moving to contact the metal bar when the electrical connector mate with a complementary connector and the pair of terminals farther disengage from the metal bar when the electrical connector unmates from the complementary connector and wherein the metal bar includes a pair of wing portions and a transition portions connecting with the pair of wing portions, and wherein the pair of wing portions are received in the recess portion in the up wall of the insulated housing.

2. The electrical connector as claimed in claim 1, wherein the metal bar is discrete from and located above the additional pair of terminals.

3. The electrical connector as claimed in claim 1, wherein each of the plurality of terminals and the additional pair of terminals comprises a mating portion, a body portion extending rearward from an end of the mating portion, a leg portion extending downward from an end of the body portion.

4. The electrical connector as claimed in claim 3, wherein the insulated housing further has a base portion supporting the mating portion of the insulated housing.

5. The electrical connector as claimed in claim 4, wherein the base portion has a body portion and a pair of supporting portions arranged at left and right ends of the body portion.

6. An electrical connector for high-speed transmission, comprising:

an insulated housing defining a mating portion, said mating portion having a bottom wall, an up wall and a pair of side walls interconnecting with the bottom and the up walls to form a receiving space;

a plurality of terminals received in the bottom wall of the insulated housing;

a slot defined on the bottom wall of the insulated housing;

an expansion portion facing to the slot of the bottom wall and formed on the up wall of the insulated housing;

wherein the expansion portion of the up wall of the insulated housing defines recess portions communicate with terminal passages;

wherein a metal bar includes a pair of wing portions and a transition portions connecting with the pair of wing portions, and wherein the pair wing portions of metal bar are received in the recess portions of the expansion of the up wall of the insulated housing; and an additional pair of terminals received in the expansion of the up wall; wherein mutual electrical connection between said additional pair of terminals is actuated by another complementary connector mated into said slot.

7. The electrical connector as claimed in claim 6, wherein the metal bar is located in the expansion of the upper wall and above the pair of terminals for selective engagement with the additional pair of terminals depending upon whether the complementary connected is mate into the slot or not.

8. The electrical connector as claimed in claim 7, wherein said metal bar is stationary while the additional pair of terminals are deflectable and adopted to be actuated by the complementary connector.

9. The electrical connector as claimed in claim 6, wherein the slot divides the bottom wall of the insulated housing into two sections with different dimensions, and wherein the expansion portion of the up wall aligns with the slot of the bottom wall.

10. An electrical connector assembly comprising:

a connector mounted upon a printed circuit board, said connector including:

an insulative housing defining a mating portion, said mating portion having a bottom wall and an up wall and two longitudinal side walls with therebetween a longitudinal slot along a lengthwise direction;

a first group of terminals located in one of said side walls with the contacting portions extending into the slot;

a second group of terminals located in the other of said side wall with at least one contacting section extending into the slot; wherein the second group of terminals including at least two switch contacts equipped with said at least one contacting section and thus configured to make an on-off status change during mating;

a recess portion defined in the upper wall of the housing a metal bar located in the recess portion and associated with the housing to electrically and mechanically connect/disconnect with regard to said switch contacts during the on-off status change; wherein the metal bar includes a pair of wing portions and a transition portions connecting with the pair of wing portions, and wherein the pair of wing portions are received in the recess portion in the up wall of the insulated housing; and further including another connector mated with said connector, wherein said another connector includes corresponding mating terminals mated with the first group of terminals while no terminals mated with the second group of terminals; wherein the first group of terminals and the second group of terminals are respectively connected to different circuit pads on the printed circuit board without direct electrical connection therebetween.

11. The connector assembly as claimed in claim 10, wherein the group of terminals and the second group of terminals are offset from each other in a transversal direction perpendicular to said lengthwise direction so that at each position along said slot, there is only one group of said first group and said second group of terminals is located beside in said transverse direction.

12. The connector assembly as claimed in claim 10, wherein said slot is uninterrupted along said lengthwise direction.

13. The connector assembly as claimed in claim 10, wherein said first group of terminals are divided into two sub-groups and essentially located by two sides of the second group of terminals taken along a transverse direction perpendicular to said lengthwise direction.

14. The connector assembly as claimed in claim 10, wherein said another connector includes a pair of mating tongues spaced from each other with a gap therebetween, and the pair of mating tongues defines two opposite ends by two sides of said gap under a condition that one of said two opposite ends actuates said at least one contacting section.

15. The connector assembly as claimed in claim 14, wherein said switch contacts are located within a range in alignment with said gap in said transverse direction.

16. The connector assembly as claimed in claim 14, wherein said two opposite ends of the pair of mating tongues are aligned with said at least two switch contacts, respectively, to actuate said at least two switch contacts.

* * * * *